United States Patent [19]

Lutz et al.

[11] 4,037,560

[45] July 26, 1977

[54] APPARATUS FOR DISCONTINUOUSLY APPLYING FLUID TO A STRAND-LIKE MATERIAL

[76] Inventors: Kurt Lutz, Strasse 35, Alte Schlierbacher; Eugen Ulmer, D-7312, Kirchheim, Teck, both of Germany

[21] Appl. No.: 667,414

[22] Filed: Mar. 16, 1976

[30] Foreign Application Priority Data

Mar. 18, 1975 Germany ..... 2511728

[51] Int. Cl.[2] ..... B05B 7/00; B05C 5/00; D06B 1/02

[52] U.S. Cl. ..... 118/314; 118/325; 68/205 R

[58] Field of Search ..... 118/314, 323, 325, 326, 118/DIG. 22, 68; 68/205 R; 28/75 R, 72.6

[56] References Cited

U.S. PATENT DOCUMENTS

| | | | |
|---|---|---|---|
| 2,234,914 | 3/1941 | Janes | 68/205 R |
| 2,428,284 | 9/1947 | Krogel | 118/314 |
| 2,883,306 | 4/1959 | Cotter | 118/325 X |
| 2,981,225 | 4/1961 | Vatt et al. | 118/325 X |
| 2,989,943 | 6/1961 | Fitzgerald et al. | 118/314 |
| 3,491,561 | 1/1970 | Crump | 118/325 X |
| 3,620,662 | 11/1971 | Miyamoto et al. | 68/205 R |
| 3,899,903 | 8/1975 | Lapierre | 68/205 R |

FOREIGN PATENT DOCUMENTS

| | | | |
|---|---|---|---|
| 1,393,202 | 5/1975 | United Kingdom | 118/323 |

*Primary Examiner*—James Kee Chi

*Attorney, Agent, or Firm*—Roylance, Abrams, Berdo & Kaul

[57] ABSTRACT

Yarn is conducted through a frame in a substantially fixed path and fluid, such as dye, is sprayed thereon. The spray nozzles include a plurality of nozzles extending downwardly from a supply tube and the tube is mounted for reciprocating movement. Another set of spray nozzles are mounted on a polygonal tube which is rotated about an axis substantially perpendicular to the yarn path. The yarn is then heated and spooled. Dye passing the yarn is collected and recirculated to the spray apparatus.

6 Claims, 3 Drawing Figures

APPARATUS FOR DISCONTINUOUSLY APPLYING FLUID TO A STRAND-LIKE MATERIAL

This invention relates to an apparatus for the discontinuous application of a liquid, such as a dye, to a strand-like material to obtain a substantially random-dyed product.

A number of techniques have been employed for randomly applying color or other liquids to yarn before incorporating the yarn into a fabric. One such technique involves conveying the fiber material past a spraying nozzle by means of thread guides which are movable essentially transversely to the direction of movement of the yarn so that the liquids sprayed on the yarn is applied in spaced-apart zones. While the technique is suitable, it involves subjecting the fiber material to substantial stress.

An object of the present invention is to provide an apparatus by which liquid can be applied to variable places along the fiber material with minimum stress to the material.

In accordance with the present invention, the apparatus includes a frame, means on the frame for guiding a yarn strand along a predetermined path relative to the frame, spray nozzle means for ejecting a spray of liquid, means for supporting the spray nozzle means on the frame and for repetitively moving the nozzle means transversely with respect to the path so that the outlet end of the spray nozzle means is repetitively and intermittently directed toward the path, and means for supplying a liquid to the spray nozzle means whereby, during the passage of the strand-like material along the path, the material is sprayed with liquid at intermittent intervals. Several spray means, longitudinally spaced in the direction of movement of the strand-like material, can be employed to apply different colors to the material.

This apparatus has the advantage of minimizing stress and strain in the yarn. The periodic movement of the spray nozzle means is selected advantageously in such a way that the liquid will be applied unevenly to the material in order to avoid the appearance of a repeat pattern or of figures when the yarn is ultimately processed into a fabric or other product. Additionally, plural nozzles can be employed spraying the same color but moving in different ways so that the application of liquid onto the strand-like material is irregular.

In order that the manner in which the foregoing and other objects are attained in accordance with the invention can be understood in detail, a particularly advantageous embodiment thereof will be described with reference to the accompanying drawings, which form a part of this specification and wherein.

Figure 1:
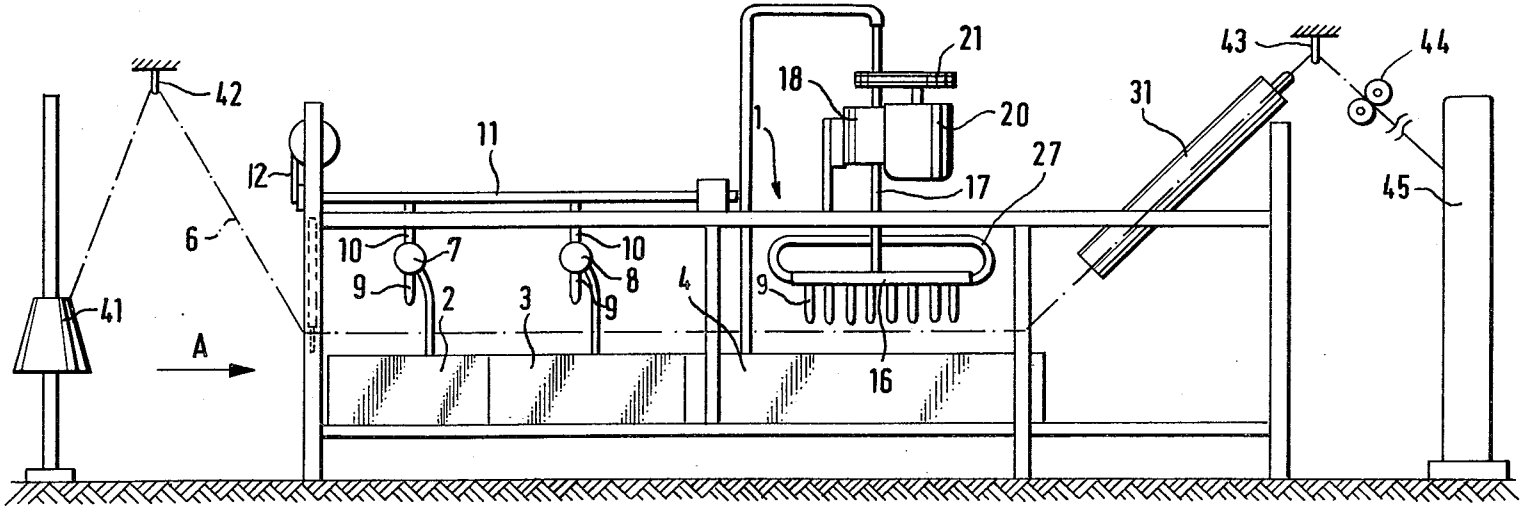
FIG. 1 is a side elevation of an apparatus according to the invention.
Figure 2:
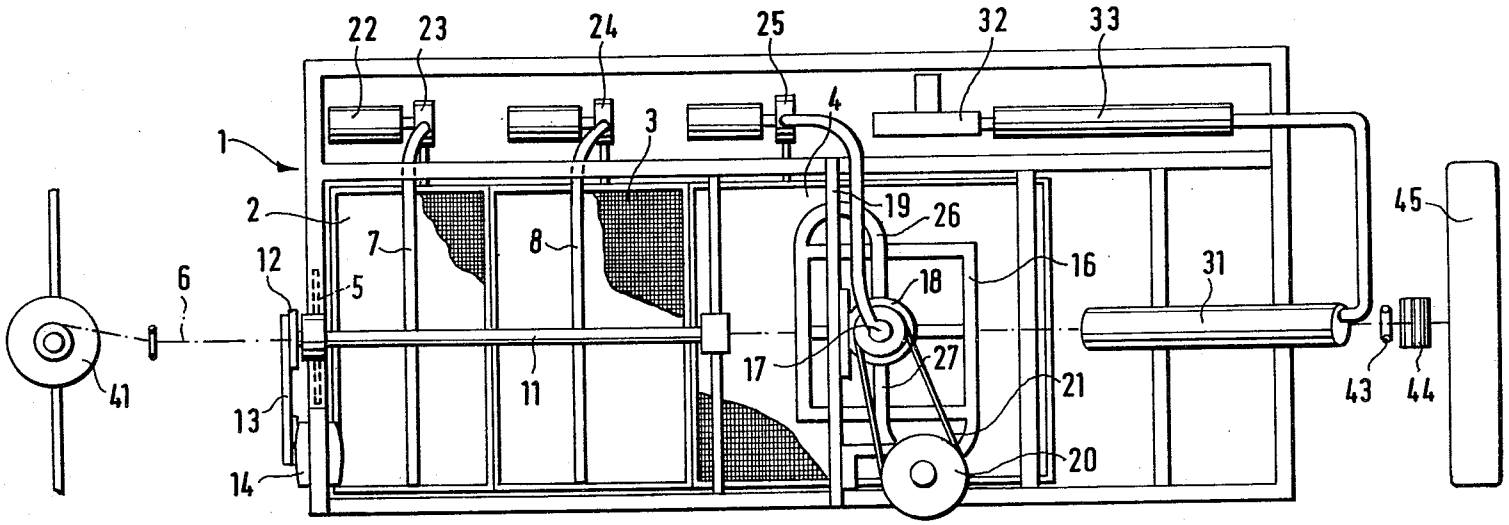
FIG. 2 is a plan view of the apparatus of FIG. 1.

As shown in the figures, the apparatus includes a frame 1 constructed, for example, of angle irons and supporting three dye containers 2, 3 and 4 supported at a distance from the bottom of the frame. The top of each dye container is covered with a fine mesh sieve as illustrated in FIG. 2. Above the dye containers there are adjustable thread guides 5 of a conventional nature for the guiding of yarns disposed side-by-side and extending in essentially parallel manner through the frame. These yarns are single yarns originating directly from a spinning frame. In the drawing, only one thread guide and one yarn 6 is illustrated for simplicity. As seen in FIG. 1, the frame and guide means guide the yarn through the frame in a substantially fixed path defined by the guides.

Figure 3:
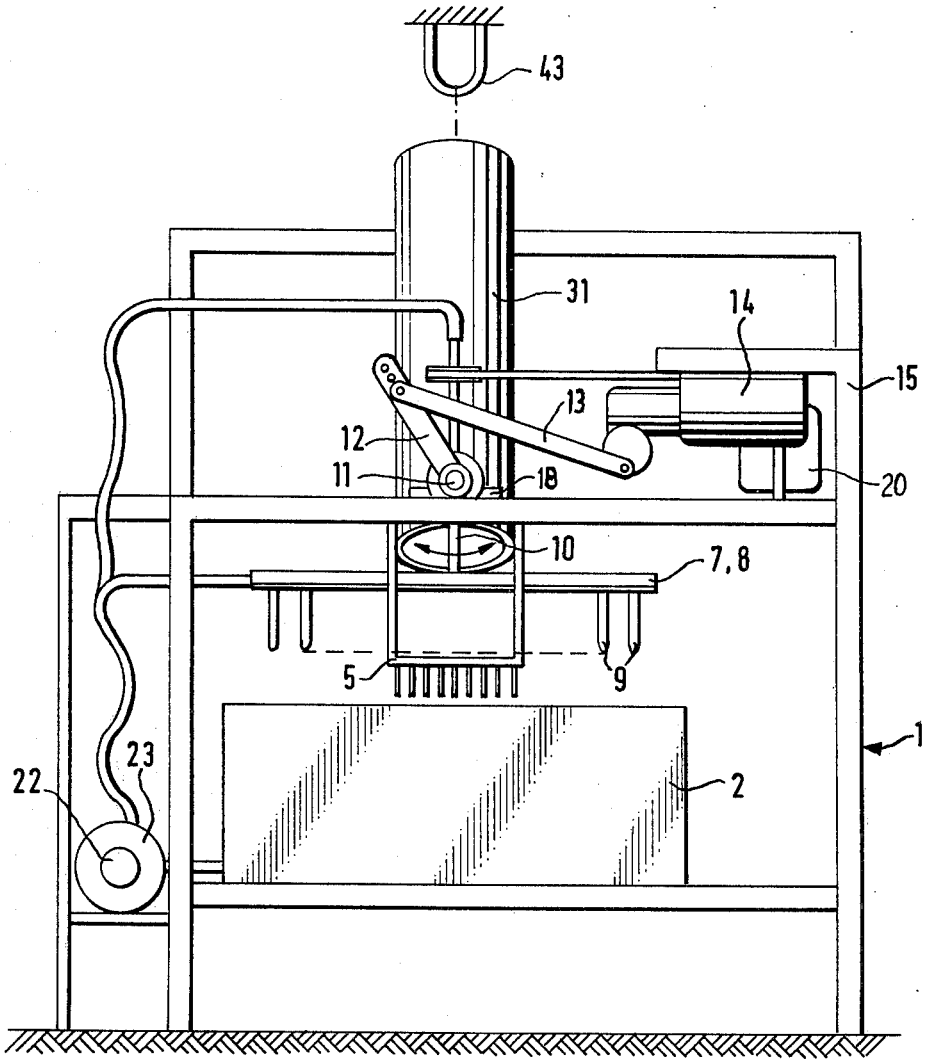
FIG. 3 is a partial front elevation of the apparatus of FIGS. 1 and 2.

Above the path of the yarn are spray means including substantially horizontal and transversely extending tubes 7 and 8, these tubes being transverse with respect to the direction of conveyance of the yarn, the tubes being disposed above specific ones of the dye containers 2 and 3. The length of each tube is shorter than the width of its related dye container. Tubes 7 and 8 are each provided with a plurality of individual downwardly extending nozzles 9 protruding from the undersides of the tubes, which nozzles are spaced apart from each other at substantially equal distances which can be, for example, on the order of 20 millimeters. Each one of tubes 7 and 8 is connected with a rocking shaft or axle 11, best seen in FIG. 3, by a downwardly extending connecting piece 10 with the rocking shaft itself being mounted for swiveling or rotational movement above the upper portion of frame 1. The length of connecting piece 10 can be adjustable as by a threaded connector. The rocking shaft 11 can be driven at a rate of, for example, 30 to 60 swinging movements per minute by means of a driving motor 14 which drives a crank and linkage assembly including an eccentric and links 12 and 13, link 12 being fixedly attached to the rocking shaft. The connection between links 12 and 13 can also be adjusted to alter the angle of transverse movement of the tube 7 or 8 and its associated nozzles. Motor 14 is mounted on a carrying arm 15 to frame 1.

A further spray nozzle means, spaced from the foregoing nozzle apparatus in the direction of movement of the yarn strand includes a jet tube 16 which is bent to form a closed, generally annular structure which, in the example shown in FIG. 2, is in the form of a square. Tube 16 is disposed above dye container 4 and is also provided with a plurality of downwardly extending nozzles which are spaced apart from each other in a manner similar to the nozzles connected to tubes 7 and 8. The spacing between nozzles 9 on tube 16 can also be in the order of 20 millimeters. The square formed by tube 16 is disposed in a horizontal plane and is supported on a shaft 17 which is rotatable about a vertical axis and is mounted in bearings 18 on a carrier 19 disposed transversely with respect to the direction of conveyance of yarn 6, the shaft being driven by a geared motor 20 which is similarly mounted with its axis vertical. Motor 20 is also supported on carrier 19 and is coupled to shaft 17 through a drive belt 21 and pulley arrangement in a conventional fashion. Tube 16 can be arranged to rotate at speeds in the range of, for example, one to 60 revolutions per minute and is normally selected to rotate at a substantially constant speed. The motor can, however, be arranged to be adjustable in speed, depending upon the nature of the material being treated.

A pump 23 is connected by a conduit to dye container 2 and is driven by a motor 22, pump 23 being arranged to withdraw liquid from container 2 and supply it through a conduit, such as a flexible tube, to tube 7. In similar fashion, a pump 24 and a pump 25 are connected to tubes 8 and 16, respectively, and to tanks 3 and 4 so that the dye from each of the containers is supplied to the tube and nozzle structures with which they are associated. It will be observed that the dye for tube 16 is delivered from pump 25 to shaft 17, which is hollow, through a rotatable connection to avoid problems associated with tangling of the conduit during rotation of tube 16. The dye is then conducted through conduits 26 and 27 to points at opposite corners of tube 16. These motor and pump arrangements thus supply liquid under pressure to the nozzle spray means in a continuous fashion.

A heat chamber 31 is mounted on frame 1 at the downstream end of the apparatus, following the location of tube 16, the yarn being guided into chamber 31 for drying. The temperature of the chamber can be elevated to a temperature of, for example, 120° C., although various temperatures can be employed depending upon the nature of the strand material being treated and the nature of the dyes employed. A motor-driven air pump 32 is located beside dye container 4 in the vicinity of pumps 23–25, air pump 32 being for the purpose of delivering air through a heat exchanger 33 and, through a suitable conduit, to the upper end of chamber 31. Heat exchanger 33 elevates the temperature of the air to the desired level so that a stream of hot air enters the upper end of chamber 31 and flows in a direction counter to the direction of motion of the yarn therethrough.

Yarn originating from a yarn package 41 is introduced through an eye 42 and thread guide 5 into the apparatus through which the previously mentioned path is defined. The yarn is guided through the frame just below the jet tubes and through a yarn guide, after which it enters heating chamber 31 and passes through a further eye 43 and a freely rotatable pair of double rollers 44, which are driven by yarn 6, to a winder or spooler 45. It is advantageous to dispose winder 45 at as large a distance as possible from the frame 1 of the apparatus. The speed of the yarn as it passes through frame 1 is advantageously in the order of from 800 to 1,000 meters per minute, although the speed can be selected to be greater or less than this range. Nozzles 9 are disposed at such a distance from yarn 6 that the dye will not spatter. The nozzles are selected to produce as fine as possible a spray of dye. If necessary, a draining nozzle can be inserted behind jet tubes 7, 8 and 16.

As previously indicated, jet tubes 7 and 8 and the nozzles connected to them continuously carry out their respective movements which are swiveling movements about shaft 11, and jet tube 16 is continuously rotated in its plane about the axis of vertical shaft 17.

It will be recognized that tube 16 can be bent into a different polygonal form, but is preferably not circular.

In the specific embodiment described hereinabove, shaft 11 extends parallel to the direction of motion of yarn 6 and jet tubes 7 and 8 extend perpendicular to the yarn path in their horizontal, middle positions. It is, however, also possible to extend shaft 11 at an angle, particularly at an acute angle, with respect to the yarn path and to establish the middle position of jet tubes 7 and 8 which is not horizontal. Further, shaft 17 can be mounted so that it rotates about an axis which deviates from the vertical and therefore makes an angle other than 90° with respect to the yarn path. Also, jet tube 16 can be mounted on shaft 17 at an angle with respect to that shaft and can also be mounted eccentrically with respect to the shaft so that the center of the annular structure is displaced from the axis about which the annular structure rotates.

While certain advantageous embodiments have been chosen to illustrate the invention, it will be understood by those skilled in the art that various changes and modifications can be made therein without departing from the scope of the invention as defined in the appended claims. There may be several squares and/or rings of tubes 16 with nozzles 9.

What is claimed is:

1. An apparatus for discontinuously applying a liquid, such as a dye, onto a strand-like material such as yarn comprising a frame;

means on said frame for guiding a yarn strand along a predetermined path relative to said frame;

spray nozzle means for ejecting a spray of liquid;

means for supporting said spray nozzle means on said frame and for repetitively moving said nozzle means transversely with respect to said path so that the outlet end of said spray nozzle means is repetitively directed toward said path;

means for supplying a liquid to said spray nozzle means whereby during the passage of the strand-like material along the path, said material is sprayed with liquid at intermittent and irregular intervals;

second spray nozzle means for ejecting a spray of liquid;

means for supporting said second spray nozzle means on said frame spaced from the first spray nozzle means in the direction of movement of the yarn strand and for rotating said second nozzle means about an axis generally perpendicular to said path so that the outlet end of said second nozzle means is repetitively directed toward said path; and means for supplying a liquid to said second spray nozzle means.

2. An apparatus according to claim 1 wherein said first spray nozzle means comprises a tube; and a plurality of individual nozzles attached to said tube and extending therefrom in substantially the same direction;

and wherein said means for supporting and moving includes axle means rotatably mounted on said frame for establishing a swivel axis having a predetermined relationship with said path;

means for supporting said tube on said axle means for movement therewith.

3. An apparatus according to claim 2 wherein said axle means is a rocking shaft and wherein said means for supporting said tube on said axle means includes means for adjusting the distance between said tube and said rocking shaft.

4. An apparatus according to claim 1 wherein said second spray nozzle means comprises a tube bent to form a closed geometric shape lying in a plane perpendicular to said axis;

a plurality of individual nozzles attached to said tube and extending therefrom in substantially the same direction;

and wherein said means for supporting and moving includes axle means for supporting said tube for rotation about an axis at an angle to the plane of said geometric shape with said individual nozzles pointing toward a plane containing said path; and means for rotating said axle means.

5. An apparatus according to claim 4 wherein said geometric shape is a polygon.

6. An apparatus according to claim 5 wherein said polygon is a square.

* * * * *